US008919056B2

(12) United States Patent
Rochman

(10) Patent No.: US 8,919,056 B2
(45) Date of Patent: Dec. 30, 2014

(54) DOOR FRAME POST, AND DOOR FRAME ASSEMBLY COMPRISING SAME AND KIT FOR ASSEMBLY OF SAME

(71) Applicant: Oded Eddy Rochman, Thornhill (CA)

(72) Inventor: Oded Eddy Rochman, Thornhill (CA)

( * ) Notice: Subject to any disclaimer, the term of this patent is extended or adjusted under 35 U.S.C. 154(b) by 0 days.

(21) Appl. No.: 14/093,223

(22) Filed: Nov. 29, 2013

(65) Prior Publication Data

US 2014/0102018 A1 Apr. 17, 2014

Related U.S. Application Data

(63) Continuation-in-part of application No. 14/068,777, filed on Oct. 31, 2013, now abandoned, which is a continuation-in-part of application No. 13/908,369, filed on Jun. 3, 2013.

(60) Provisional application No. 61/713,834, filed on Oct. 15, 2012.

(51) Int. Cl.

| | |
|---|---|
| ***E06B 1/04*** | (2006.01) |
| ***E06B 1/30*** | (2006.01) |
| ***E06B 1/32*** | (2006.01) |
| ***E06B 1/34*** | (2006.01) |

(52) U.S. Cl.

CPC ... *E06B 1/30* (2013.01); *E06B 1/32* (2013.01); *E06B 1/34* (2013.01)

USPC ..... 52/210; 52/204.1; 52/211

(58) Field of Classification Search

USPC ..... 52/210, 204.1, 211

See application file for complete search history.

(56) References Cited

U.S. PATENT DOCUMENTS

| | | | | | |
|---|---|---|---|---|---|
| 3,875,713 | A * | 4/1975 | Laborde | 52/288.1 |
| 5,378,077 | A * | 1/1995 | Paulsen | 403/402 |
| 5,557,899 | A * | 9/1996 | Dube et al. | 52/455 |
| 5,634,300 | A * | 6/1997 | Huebner et al. | 52/36.1 |
| 5,758,458 | A * | 6/1998 | Ridge | 52/204.1 |
| 5,941,033 | A * | 8/1999 | Adams | 52/212 |
| 6,148,582 | A * | 11/2000 | Ellingson | 52/656.4 |
| 6,155,011 | A * | 12/2000 | Robertson | 52/212 |
| 6,295,779 | B1 * | 10/2001 | Canfield | 52/656.4 |
| 6,568,137 | B2 * | 5/2003 | Ballantyne | 52/211 |
| 6,604,334 | B2 * | 8/2003 | Rochman | 52/717.01 |
| 6,966,158 | B1 * | 11/2005 | Christensen | 52/213 |
| 7,043,883 | B1 * | 5/2006 | Cederberg et al. | 52/204.1 |
| 7,228,663 | B2 * | 6/2007 | Schiedegger et al. | 52/211 |
| 7,472,519 | B2 * | 1/2009 | Careri | 52/210 |
| 7,533,503 | B2 * | 5/2009 | Wang | 52/217 |
| 7,971,400 | B2 * | 7/2011 | Boldt et al. | 52/204.1 |
| 8,484,913 | B2 * | 7/2013 | Charbonneau | 52/210 |
| 2002/0069604 | A1 * | 6/2002 | Canfield | 52/656.4 |
| 2002/0083663 | A1 * | 7/2002 | Ballantyne | 52/204.1 |
| 2002/0166299 | A1 * | 11/2002 | Day | 52/211 |
| 2004/0182040 | A1 * | 9/2004 | Schiedegger et al. | 52/717.01 |
| 2006/0123719 | A1 * | 6/2006 | Careri | 52/204.5 |
| 2007/0022699 | A1 * | 2/2007 | Wang | 52/656.4 |
| 2008/0072506 | A1 * | 3/2008 | LeGoff | 52/204.1 |
| 2008/0178541 | A1 * | 7/2008 | Kerscher et al. | 52/204.1 |
| 2013/0219813 | A1 * | 8/2013 | Gadoury | 52/211 |
| 2013/0263536 | A1 * | 10/2013 | Peck et al. | 52/211 |

* cited by examiner

*Primary Examiner* — Mark Wendell

(57) ABSTRACT

A door frame post comprises an extruded, longitudinal post member comprising at least one longitudinal internal cavity and a longitudinal external channel, and a longitudinal frame member matingly engaging the external channel of the post member. One or more longitudinal filler strips are inserted into the at least one internal cavity, each filler strip comprising at least one longitudinal cavity for receiving one or more fasteners.

16 Claims, 12 Drawing Sheets

DOOR FRAME POST, AND DOOR FRAME ASSEMBLY COMPRISING SAME AND KIT FOR ASSEMBLY OF SAME

CROSS-REFERENCE TO RELATED APPLICATIONS

This application is a continuation-in-part of U.S. patent application Ser. No. 14/068,777 filed on Oct. 31, 2013, which is a continuation-in-part of U.S. patent application Ser. No. 13/908,369 filed on Jun. 3, 2013, which claims the benefit of provisional U.S. application Ser. No. 61/713,834 filed on Oct. 15, 2012, the contents of which are herein incorporated by reference in their entireties.

FIELD OF THE INVENTION

The present invention relates generally to door frames and in particular, to a door frame post, and a door frame assembly comprising the same and a kit for assembly of the same.

BACKGROUND OF THE INVENTION

Door frames of dwellings and other buildings are often constructed by installing wooden side plates and a wooden top plate around a doorway opening. Wooden casings are typically attached to the edges of the side and top plates. Hinges and lock set recesses are then added to opposite side plates.

As will be appreciated, this approach requires considerable handiwork and the exercise of some degree of skill. It also requires significant on site labour, and is typically time-consuming. Additionally, this approach also does not provide for weather proofing, and weather proofing typically needs to be improvised by attaching weather stripping around the edges of the doorway opening.

To facilitate door frame construction, it may be desirable and more cost-effective to utilize a pre-fabricated door jamb comprising inexpensive structural materials such as plastic. Door jambs comprising extruded plastic have been previously described. For example, U.S. Pat. No. 6,557,309 to Johnson discloses a door jamb assembly having an interchangeable multi-component design allowing for the framing of doorways with different configurations by first selecting a main frame and a decorative trim that conforms with the doorway, and then securing a first end of the main frame, being attached to the decorative trim, onto a wall with the use of an attachment flange and securing a second end of the main frame to an interior jamb with the use of a fastener.

U.S. Pat. No. 7,472,519 to Careri discloses a plastic door jamb member for forming a portion of a door jamb, the plastic member having a recess for receiving a wooden door jamb portion, and an interlocking attachment recess for interconnection with a metal reinforcement plate. The plastic door jamb member may be interengaged with the wooden door jamb portion, and further interengaged with the metal reinforcement plate, and installed in position as a combination door jamb assembly.

Door frame posts for door frames have also been described. For example, PCT Application No. WO 2009093205 to Sciara discloses a standard post for door and window frames comprising an elongate body with a longitudinal axis, an inner edge and an outer edge substantially parallel to the longitudinal axis and end edges substantially transverse to the longitudinal axis. The end edges are both inclined to the longitudinal axis, with substantially identical angles of inclination, one of the inclined edges being designed to be removed upon installation by a cut substantially at right angles to the longitudinal axis to define the lower end of the post, whereas the other one of the inclined edges is designed for connection with the lintel.

Improvements are generally desired. It is therefore an object at least to provide a novel door frame post, and a door frame assembly comprising the same and a kit for assembly of the same.

SUMMARY OF THE INVENTION

In one aspect, there is provided a door frame post comprising: an extruded, longitudinal post member comprising at least one longitudinal internal cavity and a longitudinal external channel; a longitudinal frame member matingly engaging the external channel of the post member; and one or more longitudinal filler strips inserted into the at least one internal cavity, each filler strip comprising at least one longitudinal cavity for receiving one or more fasteners.

Each filler strip may be extruded.

Each filler strip may be formed separately from the post member.

The one or more fasteners may be screws.

The frame member may comprise a shaped longitudinal portion for matingly engaging the external channel of the post member. The frame member may further comprise at least one longitudinal groove adjacent the shaped longitudinal portion, and wherein the post member further comprises at least one longitudinal clip member disposed adjacent the external channel, each clip member engaging a respective longitudinal groove.

The post member further comprises at least one additional external channel for accommodating weather stripping.

In one embodiment, a door frame assembly comprises one or more of the door frame post. The door frame assembly may further comprise a longitudinal header, the door frame post being fastened to the header intermediate its longitudinal ends. The door frame assembly may further comprise a longitudinal sill, the door frame post being fastened to the sill intermediate its longitudinal ends.

In another aspect, there is provided a kit for assembly of a door frame post, comprising: an extruded, longitudinal post member comprising at least one longitudinal internal cavity and a longitudinal external channel; a longitudinal frame member configured for matingly engaging the external channel of the post member; and one or more longitudinal filler strips, each filler strip comprising at least one longitudinal cavity for receiving one or more fasteners, each filler strip being one of: inserted into a respective internal cavity, or configured to be inserted into a respective internal cavity.

The frame member may be one of (i) separate from, or (ii) secured to, the post member.

Each filler strip may be extruded.

Each filler strip may be formed separately from the post member.

The frame member may comprise a shaped longitudinal portion for matingly engaging the external channel of the post member. The frame member may further comprise at least one longitudinal groove adjacent the shaped longitudinal portion, and wherein the post member further comprises at least one longitudinal clip member disposed adjacent the external channel, each longitudinal clip member: engaging a respective groove, or being configured to engage a respective groove.

The post member may further comprise at least one additional internal cavity.

The post member may further comprise at least one additional external channel for accommodating weather stripping.

BRIEF DESCRIPTION OF THE DRAWINGS

Embodiments will now be described more fully with reference to the accompanying drawings in which.

DETAILED DESCRIPTION OF THE EMBODIMENTS

Figure 1:
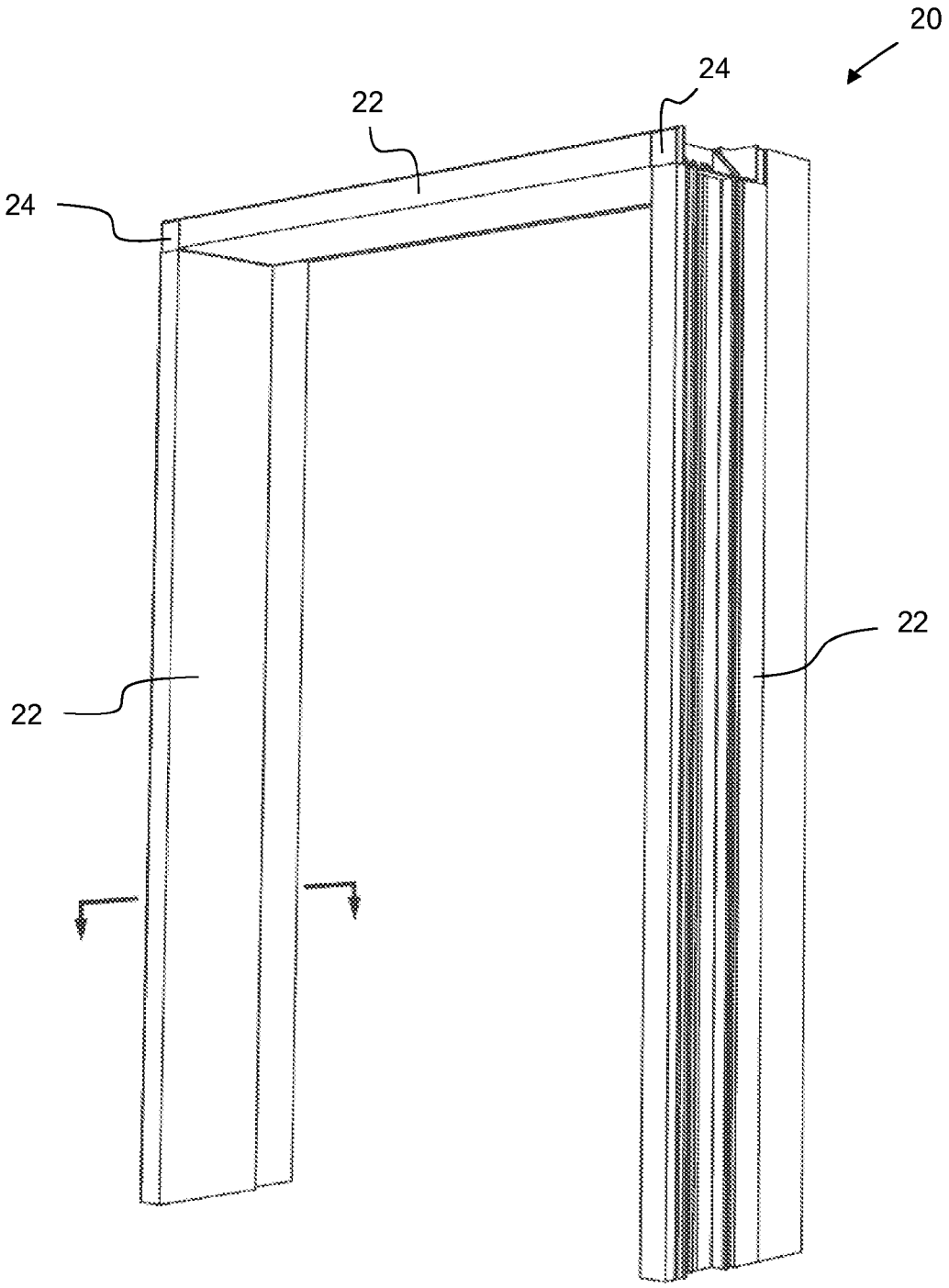
FIG. 1 is a perspective view of a door jamb assembly.
Figure 2A:
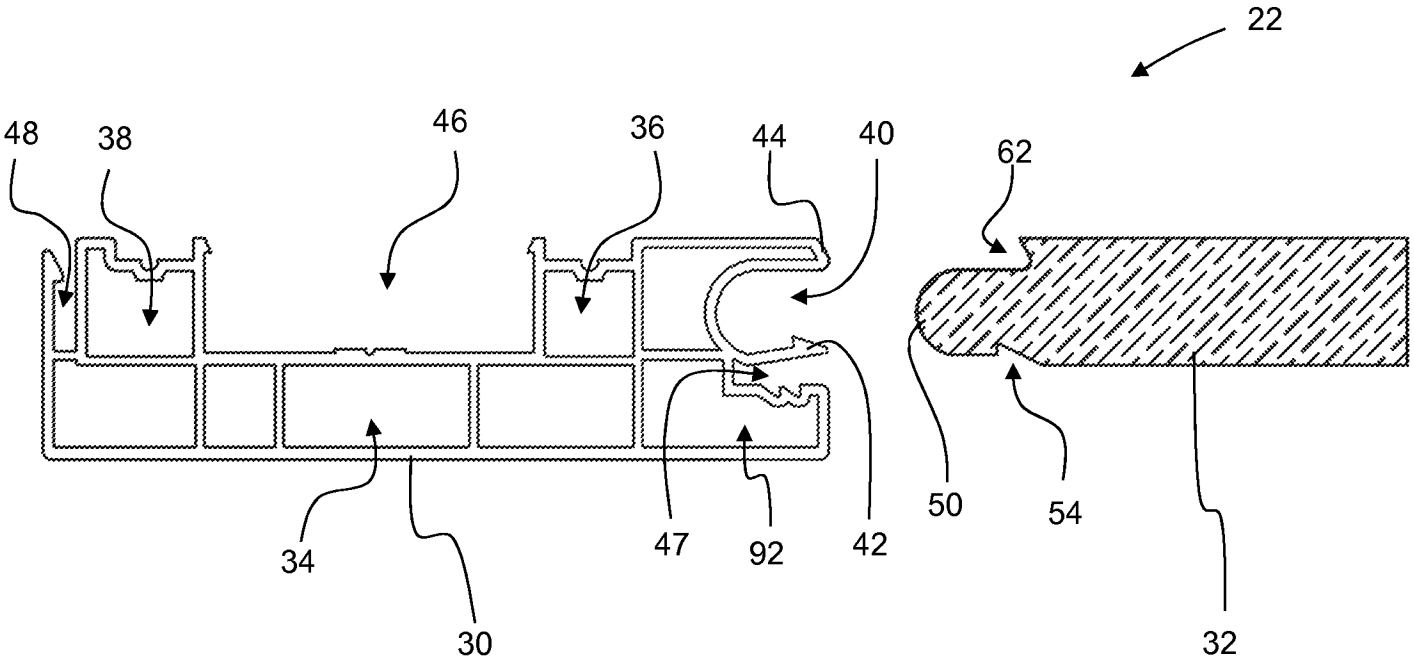
FIGS. 2*a* and 2*b* are exploded sectional and sectional views, respectively, of a door jamb portion forming part of the door jamb assembly of FIG. 1, and taken along the indicated section line.
Figure 2B:
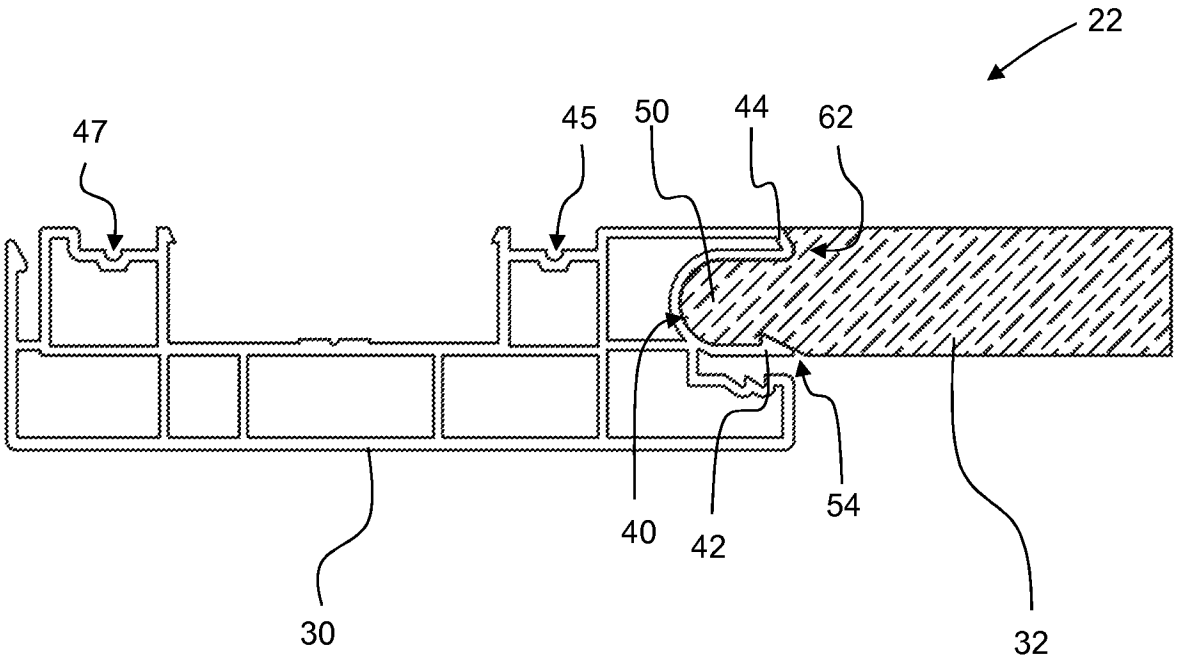

Turning now to FIG. 1, a door jamb assembly is shown and is generally indicated by reference numeral 20. Door jamb assembly 20 is configured to be installed in a doorway opening (not shown) of a wall for accommodating a door (not shown). The door jamb assembly 20 comprises three (3) door jamb portions 22 that are connected by two (2) corner keys 24.

The door jamb portion 22 may be better seen in FIGS. 2 to 5. Each door jamb portion 22 comprises an extruded, longitudinal door jamb member 30 and a longitudinal frame member 32. In this embodiment, the door jamb member 30 is fabricated of polyvinyl chloride (PVC) "cap stock", and is formed by co-extrusion of recycled (or "regrind") PVC and new PVC so as to provide a body of recycled PVC that is coated with layer of new PVC, as is known in the art. The door jamb member 30 comprises a plurality of longitudinal internal cavities, which extend the length of the door jamb member 30 and which are separated by longitudinal internal webs. In the embodiment shown, the door jamb member 30 comprises a first internal cavity 34, a second internal cavity 36 and a third internal cavity 38.

The door jamb member 30 also comprises a plurality of longitudinal channels that extend the length of the door jamb member 30. In the embodiment shown, the door jamb member 30 comprises a rounded channel 40 that extends the length of the door jamb member 30, and which is configured to engage the frame member 32 as described below. The door jamb member 30 further comprises a biased, longitudinal clip member 42 disposed along a first side of the rounded channel 40, and a longitudinal rib 44 disposed along a second side of the rounded channel 40. Additionally, the door jamb member 30 comprises a channel 46 that is sized and shaped for accommodating a longitudinal reinforcement member (not shown) having a corresponding profile. The door jamb member 30 further comprises a channel 47 that is sized and configured to accommodate weather stripping, and a biased, longitudinal clip member 48 spaced from a longitudinal external corner 49 which together define an external, longitudinal channel 51 therebetween. The channel 51 is configured to accommodate trim surrounding the exterior of the doorway opening, such as for example a brick mold portion.

In this embodiment, each frame member 32 is formed by machining a longitudinal wooden board. In the embodiment shown, the frame member 32 comprises a rounded longitudinal edge 50, a longitudinal groove 52 disposed along a first side of the rounded longitudinal edge 50, and a longitudinal notch 62 disposed along a second side of the rounded longitudinal edge 50.

The rounded longitudinal edge 50 of the frame member 32 and the rounded channel 40 of the door jamb member 30 are configured to matingly engage so as to form a "bullnose" joint therebetween. When engaged in this manner, the longitudinal rib 44 matingly engages the longitudinal notch 62, and maintains the door jamb member 30 and the frame member 32 in a parallel relationship. Additionally, when engaged in this manner, the biased, longitudinal clip member 42 engages the longitudinal groove 52 so as to secure the frame member 32 and the door jamb member 30 to each other. In this embodiment, the frame member 32 and the door jamb member 30 are further secured to each other by glue disposed between the rounded longitudinal edge 50 and the rounded channel 40.

Figure 3:
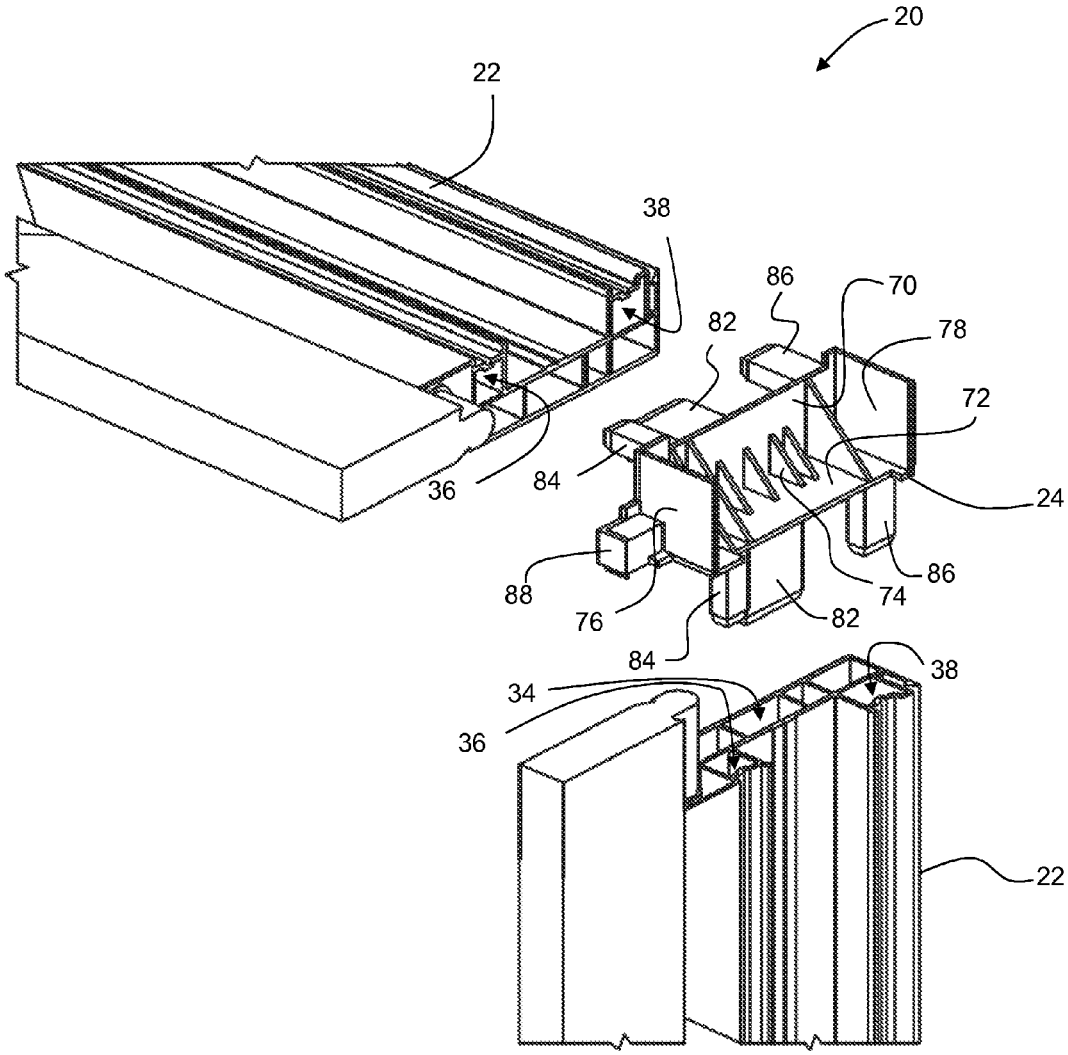
FIG. 3 is an exploded, upper perspective view of a portion of the door jamb assembly of FIG. 1.
Figure 4:
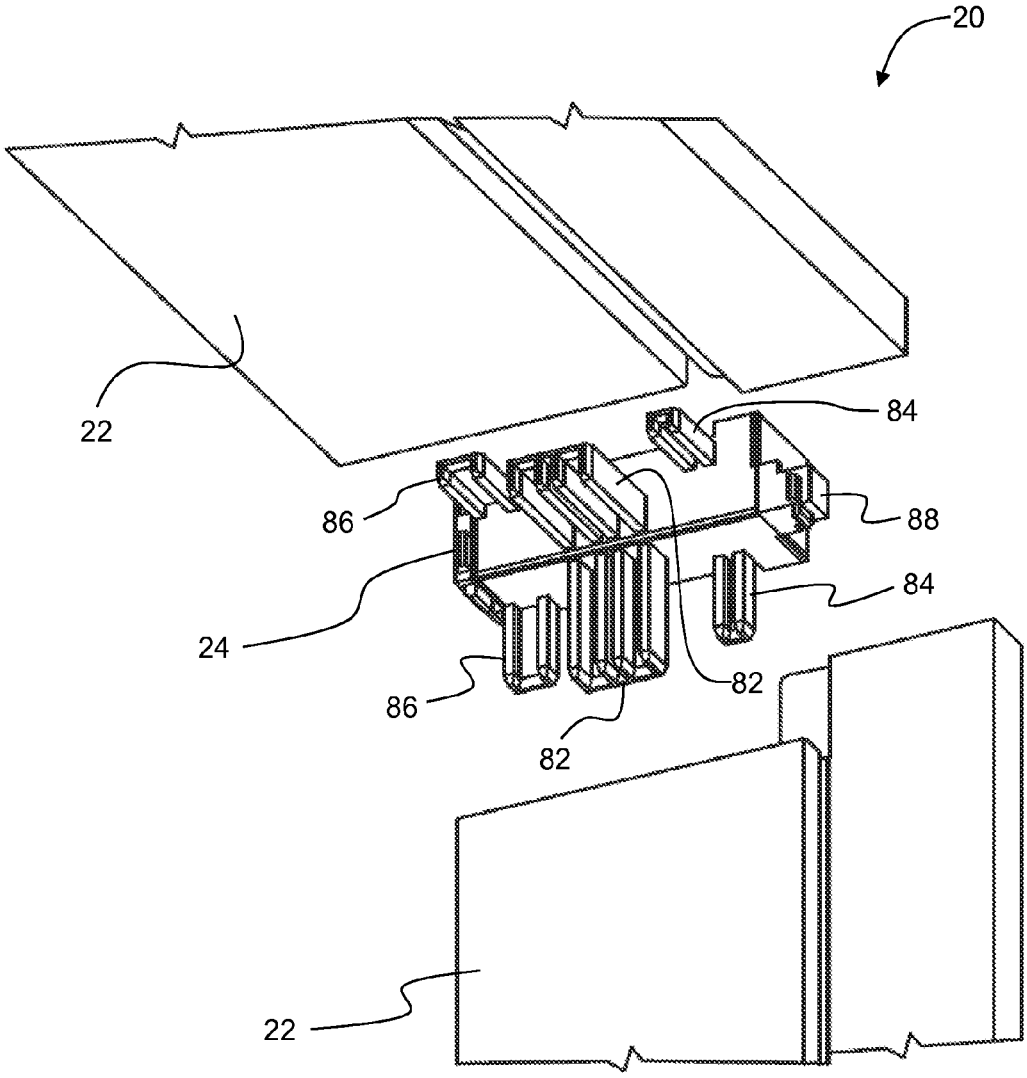
FIG. 4 is an exploded, lower perspective view of the portion of the door jamb assembly of FIG. 3.
Figure 5:
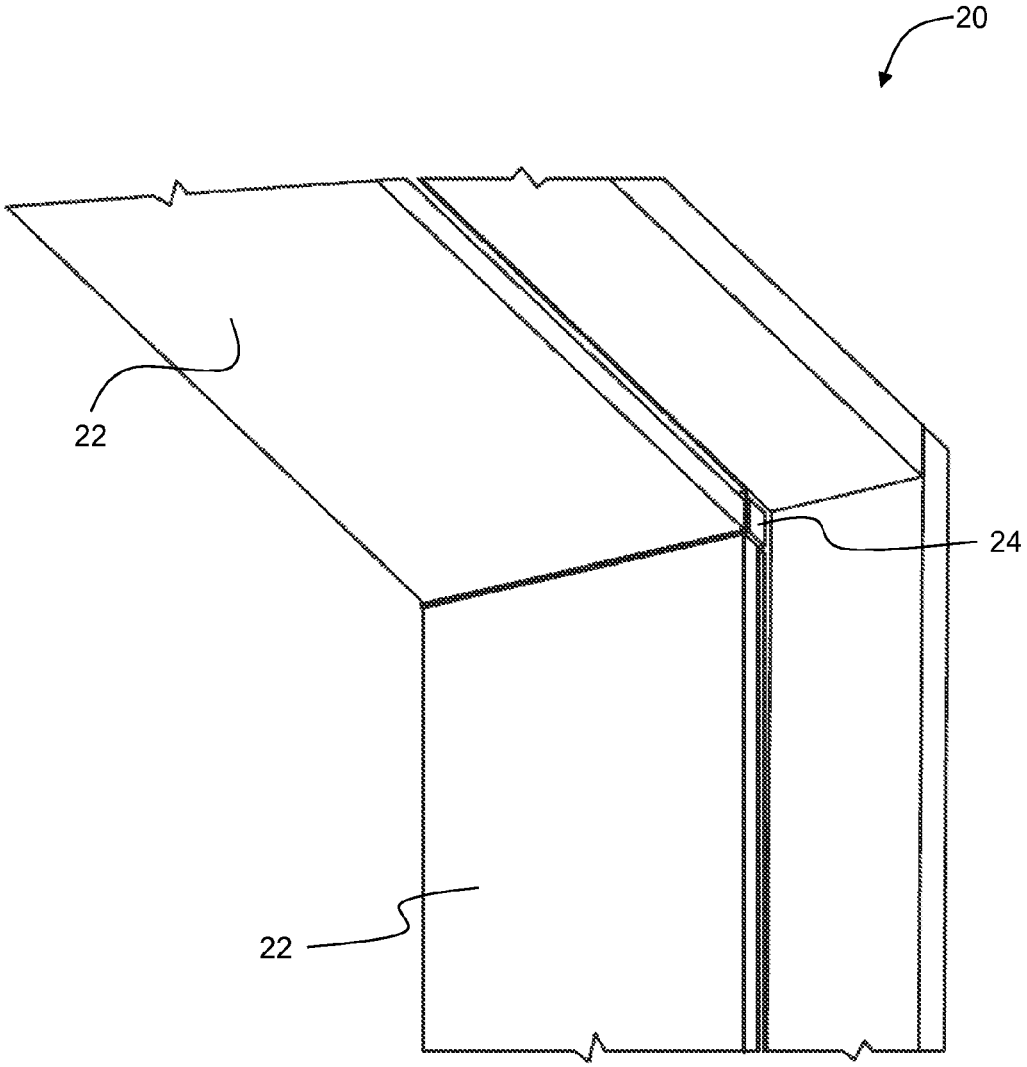
FIG. 5 is a lower perspective view of the portion of the door jamb assembly of FIG. 3.

The corner key 24 may be better seen in FIGS. 3 and 4. Each corner key 24 is a discrete and separate part from the door jamb portion 22. In this embodiment, each corner key 24 is fabricated of glass-filled nylon by injection molding. Each corner key 24 is generally shaped to engage the internal cavities 34, 36 and 38 of two (2) door jamb members 30, so as to form a generally ninety (90) degree, or a generally "right-angled", joint between two (2) door jamb portions 22. Each corner key 24 comprises a first panel 70 and a second panel 72 that are connected along a common edge, and which are oriented generally orthogonally to each other. The first and second panels 70 and 72 are supported in relation to each other by gussets 74, and by a first end panel 76 and a second end panel 78. A set of pins extends outwardly from each of the first and second panels 70 and 72. In the embodiment shown, each set of pins comprises a first pin 82, a second pin 84 and a third pin 86 extending from each of the first and second panels 70 and 72, and which are sized and positioned to engage the first internal cavity 34, the second internal cavity 36 and the third internal cavity 38, respectively, of the door jamb member 30. The corner key 24 further comprises a cap pin 88 extending from the first end panel 76, which is sized and positioned to cover the channels 54 and interior cavities 92, when the corner key 24 connects the two (2) door jamb portions 22.

In use, the door jamb assembly 20 is assembled by providing two (2) corner keys 24 and three (3) door jamb portions 22, and namely two (2) door jamb portions 22 having a first length and one (1) door jamb portion 22 having a second length, the first length being greater than the second length. In this embodiment, each door jamb portion 22 is provided with the door jamb member 30 already secured to the frame member 32. Each end of the door jamb portion 22 having the second length is then connected to a corresponding end of a door jamb portion 22 having the first length using a corner key 24. In particular, adjacent door jamb portions 22 are connected by inserting a first pin 82, a second pin 84 and a third pin 86 of the corner key 24 into the first internal cavity 34, the second internal cavity 36 and the third internal cavity 38, respectively, of each adjacent door jamb portion 22. Once assembled, the assembled door jamb assembly may then be installed in a suitably-sized doorway opening in a wall, such that the one (1) door jamb portion 22 having the second length is oriented generally horizontally as a "header" and the two (2) door jamb portions 22 having the first length are oriented generally vertically.

Figure 6:
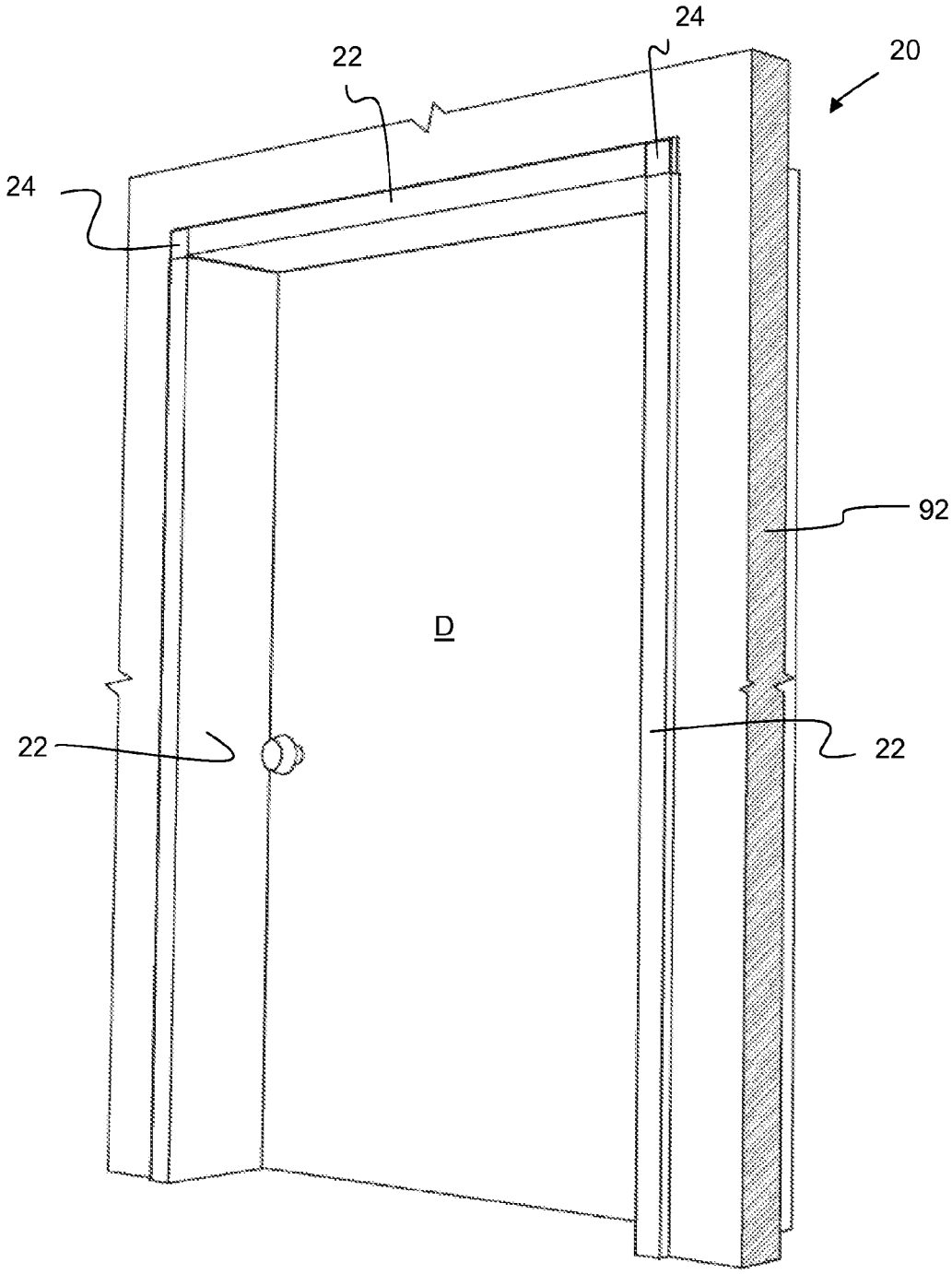
FIG. 6 is a perspective view of the door jamb assembly of FIG. 1, installed in a doorway opening.

FIG. 6 shows the door jamb assembly 20 installed in a doorway opening of a wall 92. Hinges (not shown) and lock set recesses (not shown) have been added to the frame members of the vertically-oriented door jamb portions 22 for accommodating a door D.

Figure 7:
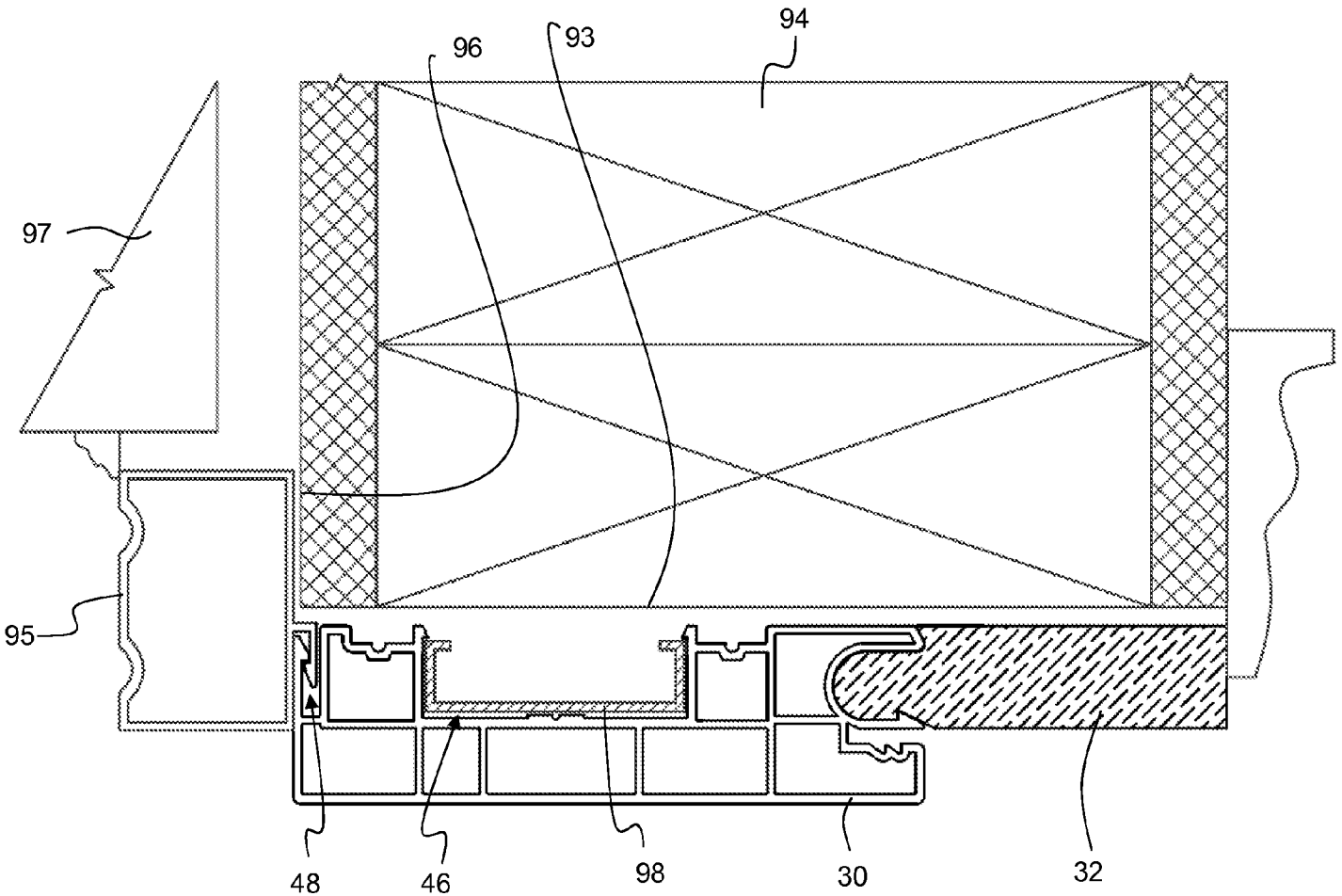
FIG. 7 is a sectional view of the door jamb portion of FIG. 2*b*, installed in a doorway opening and having a brick mold fitted thereto.
Figure 8:
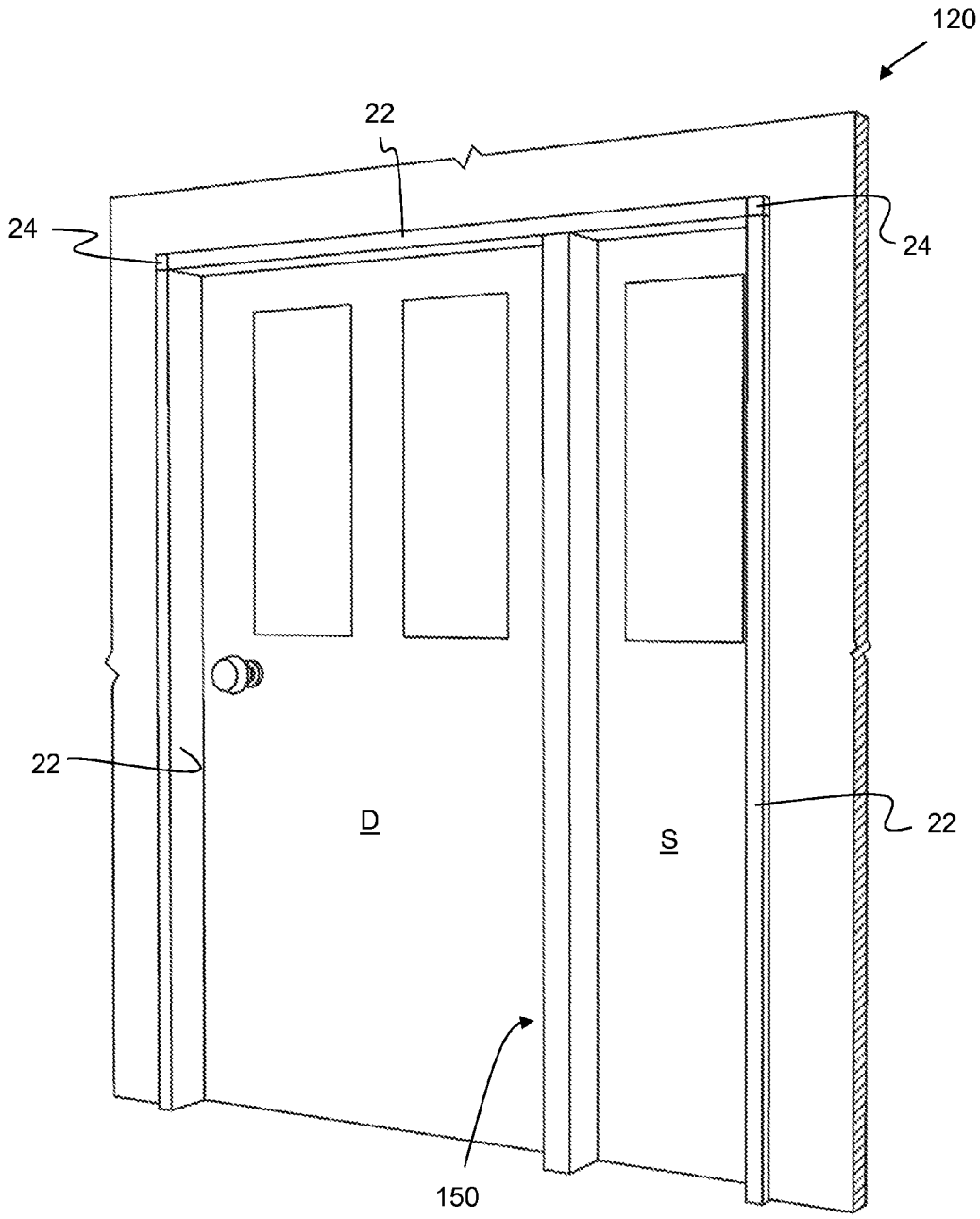
FIG. 8 is a perspective view of another embodiment of a door jamb assembly, installed in a doorway opening.
Figure 9:
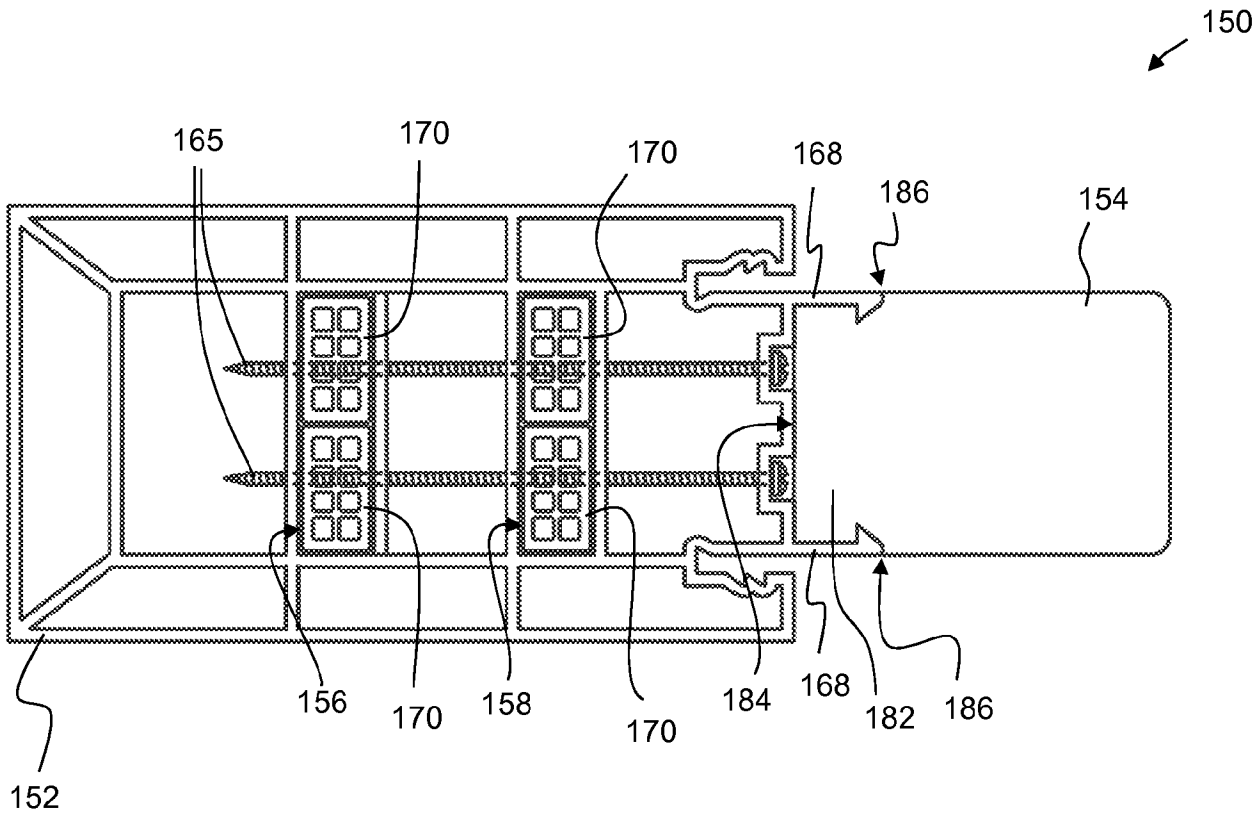
FIG. 9 is a sectional view of a door frame post forming part the door jamb assembly of FIG. 8.
Figure 10B:
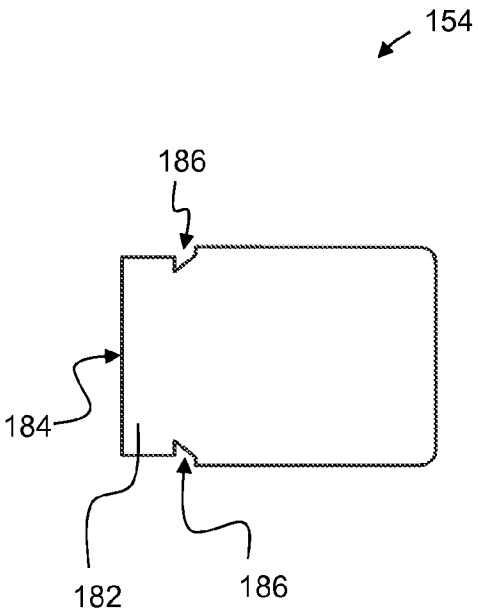
FIGS. 10*a* and 10*b* are sectional views of a post member and a frame member, respectively, forming part the door frame post of FIG. 9.
Figure 10A:
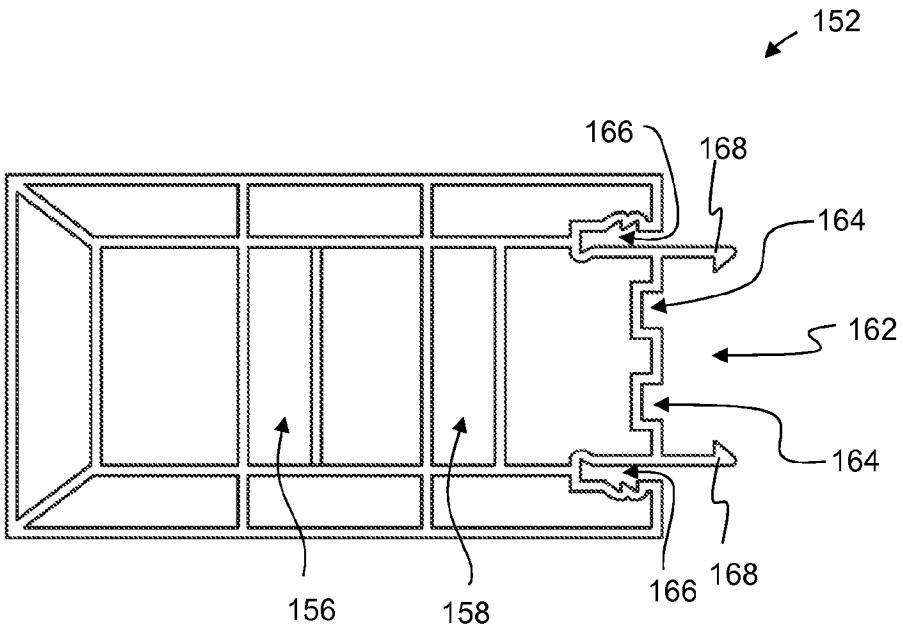

FIG. 7 shows the door jamb portion 22 of the door jamb assembly 20 installed in another embodiment of a doorway opening of an exterior wall of a building, such as for example a house. As may be seen, the door jamb member 30 and the frame member 32 are positioned generally adjacent an inner surface 93 of a frame 94 surrounding the doorway opening. As may be seen, trim in the form of a longitudinal brick mold portion 95 is accommodated by the longitudinal channel 51, for generally finishing the joint between the door jamb portion 22 and an exterior surface 96 of the doorway opening frame 94 and a surface of an exterior brick wall 97. Additionally, in the embodiment shown, a reinforcement member in the form of a bar 98 having a "C"-shaped cross-sectional profile is accommodated by the channel 46, for generally providing reinforcement to the door jamb portion 22.

As will be appreciated, the "bullnose" joint formed between the rounded longitudinal edge 50 of the frame member 32 and the rounded channel 40 of the door jamb member 30 is strong, and is simple in design and may advantageously be fabricated at a low cost. Moreover, the inherent strength of the "bullnose" joint advantageously eliminates the need for additional fasteners between the door jamb member 30 and the frame member 32, such as for example screws. Additionally, the rounded longitudinal edge 50 can advantageously be formed in a facile manner, and without forming burrs or surface roughness that might otherwise occur during formation of non-rounded edges by machining As will be understood, the absence of burrs or surface roughness advantageously ensures a secure fit between the rounded channel 40 and the rounded longitudinal edge 50. Additionally, and as will be understood, the rounded longitudinal edge 50 does not have longitudinal corners or edges that would otherwise be likely to tear or chip upon insertion into a receiving channel of a member fabricated of non-wooden material.

As will be appreciated, the corner key 24 is configured to join two (2) door jamb portions 22 without requiring the ends of the door jamb portions 22 to be cut to a specific angle, other than the 90 degree angle formed during manufacture of the door jamb member 30. As will be appreciated, this eliminates the need to modify the ends of the door jamb portions 22, such as for example by cutting an end to a 45 degree angle by miter saw, during on site assembly of the door jamb assembly 20. This allows the door jamb assembly 20 to be assembled from "stock" or unmodified parts, which advantageously reduces the cost of assembly of the door jamb assembly 20, and which advantageously allows parts that may have been damaged during transport or during assembly to be easily replaced.

Other configurations are possible. For example, FIGS. 8 to 12 show another embodiment of a door jamb assembly, which is generally indicated by reference numeral 120. Door jamb assembly 120 is configured to be installed in a doorway opening of an exterior wall of a building for accommodating a door D and a sidelight panel S. The door jamb assembly 120 comprises three (3) door jamb portions 22, namely two (2) door jamb portions 22 configured to be oriented generally vertically and one (1) door jamb portion 22 configured to be oriented generally horizontally as a "header", that are connected by two (2) corner keys 24. In this embodiment, each door jamb portion 22 comprises an extruded, longitudinal door jamb member 30 and a longitudinal frame member 32, as described above and with reference to FIGS. 1 to 6. As may be seen, the header door jamb portion 22 is sized to extend generally the widths of the door D and the sidelight panel S.

The door jamb assembly 120 also comprises a door frame post 150 that is configured to be fastened to the header door jamb portion 22. The door frame post 150 may be better seen in FIGS. 9 to 12. The door frame post 150 comprises an extruded, longitudinal post member 152 and a longitudinal frame member 154. In this embodiment, the post member 152 is fabricated of PVC "cap stock", and is formed by co-extrusion of recycled (or "regrind") PVC and new PVC so as to provide a body of recycled PVC that is coated with layer of new PVC, as is known in the art. The post member 152 comprises a plurality of longitudinal internal cavities, which extend the length of the post member 152 and which are separated by longitudinal internal webs. In the embodiment shown, the post member 152 comprises a first cavity 156 and a second cavity 158.

The post member 152 also comprises a plurality of longitudinal external channels extending the length thereof. In the embodiment shown, the post member 152 comprises a central channel 162 that is configured to engage the frame member 154, as described below. The post member 152 also comprises two (2) longitudinal channels 164 within the central channel 162, with each channel 166 being shaped to receive a fastener 165 and to provide a recess for accommodating a head of the fastener 165. In the embodiment shown, the fasteners are screws. The post member 152 further comprises two (2) longitudinal channels 166, with each channel 166 being disposed adjacent the central channel 162 and being configured for accommodating weather stripping. Additionally, the post member 152 comprises two (2) biased, longitudinal clip members 168, each clip member 168 being disposed along a respective side of the central channel 162.

The post member 152 is configured to accommodate one or more longitudinal filler strips 170, with each filler strip 170 being inserted into a cavity 156 or 158. Each filler strip 170 is sized to have at least one cross-sectional dimension that is generally commensurate with a cross-sectional dimension of the cavity 156 or 158, for enabling each filler strip 170 to be inserted into the cavity 156 or 158 in a press fit manner. In the embodiment shown, the filler strips 170 are sized such that each cavity 156 and 158 accommodates two (2) filler strips 170 inserted therein, as may be seen in FIG. 13*b*.

Figure 12:
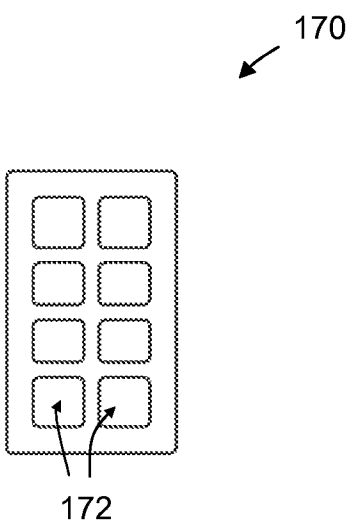
FIG. 12 is an end view of the filler strip of FIG. 11.
Figure 11:
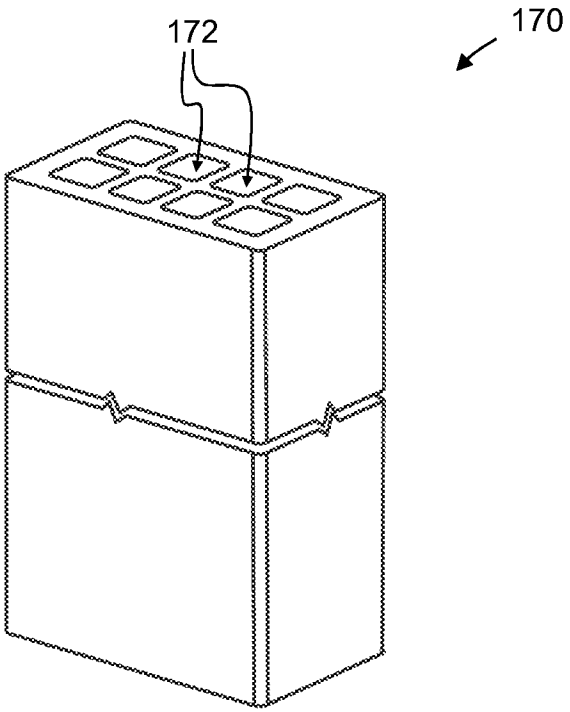
FIG. 11 is a perspective view of a filler strip forming part of the door frame post of FIG. 9.

The filler strip 170 may be better seen in FIGS. 11 and 12. Each filler strip 170 is formed by extrusion and is formed separately from the post member 152, and in this embodiment each filler strip 170 is formed of extruded PVC. Each filler strip 170 comprises a plurality of longitudinal cavities 172 extending the length thereof, each being sized for receiving one or more fasteners at one or both ends for assembly of the door jamb assembly 120.

In this embodiment, the frame member 154 is formed by machining a longitudinal wooden board. The frame member 154 comprises a shaped longitudinal portion 182 extending along a longitudinal side 184 thereof, and two (2) longitudinal grooves 186, with each longitudinal groove 186 being disposed along a respective side adjacent the longitudinal portion 182. The longitudinal portion 182 and the central channel 162 of the post member 152 are configured to matingly engage so as to form a butt joint therebetween. When engaged in this manner, the biased, longitudinal clip members 168 engage the longitudinal grooves 186 for securing the frame member 154 and the post member 152 together. In this embodiment, the frame member 154 and the post member 152 are further secured to each other by glue disposed between the longitudinal portion 182 and the central channel 162.

In use, the door jamb assembly 120 is assembled by providing the two (2) corner keys 24 and the three (3) door jamb portions 22, and namely the two (2) door jamb portions 22 configured to be oriented generally vertically and the one (1) header door jamb portion 22 configured to be oriented generally horizontally. In this embodiment, each door jamb portion 22 is provided with the door jamb member 30 already secured to the frame member 32. Each end of the header door jamb portion 22 is then connected to a corresponding end of a door jamb portion 22 configured to be oriented generally vertically using a corner key 24, in the manner described above for door jamb assembly 20 and with reference to FIGS. 1 to 6.

The door frame post 150 is assembled by inserting filler strips 170 into the cavities 156 and 158 of the post member 152. At least two (2) fasteners 165 are then driven through each channel 166 of the post member 152, and through filler strips 170 inserted therein, so as to secure the filler strips 170 within the post member 152. In this embodiment, at least one (1) fastener 165 is driven into each channel 166 near each end of the post member 152. Once the fasteners 165 have been driven into both channels 166 into the post member 152, the post member 152 and the frame member 154 are secured to each other to provide the assembled door frame post 150.

The assembled door frame post 150 and the header door jamb portion 22 are then fastened together using fasteners, and in this embodiment the fasteners are screws. Specifically, and with reference to FIG. 2*b*, the door frame post 150 and the header door jamb portion 22 are fastened together by abutting an end of the door frame post 150 against a side of the header door jamb portion 22 at a suitable position intermediate its longitudinal ends, and: inserting at least one fastener through the longitudinal guide groove 45 and through the door jamb portion 22 into an aperture 172 of the filler strip 170 positioned in the second cavity 158 of the post member 152, which causes the filler strip 170 to expand within the second cavity 158 and to thereby become compressively secured to the post member 152; and/or by inserting at least one fastener through the longitudinal guide groove 47 and through the door jamb portion 22 into an aperture 172 of the filler strip 170 positioned in the first cavity 156 of the post member 152, which causes the filler strip 170 to expand within the first cavity 156 and thereby become compressively secured to the post member 152. The assembled door jamb assembly 120 may then be installed within a doorway opening in a wall, such that the two (2) door jamb portions 22 and the door frame post 150 are oriented generally vertically and the one (1) header door jamb portion 22 fastened to the door frame post 150 is oriented generally horizontally.

As will be appreciated, the door frame post 150 may be connected to a single, continuous header for providing suitable framing for both a door and a sidelight, and advantageously provides a simpler construction approach as compared to conventional door frame assemblies comprising posts, for which a separate box/enclosure for each door and panel is generally required to be constructed within a larger frame. Further, and as will be understood, an opposite end of the door frame post 150 may be connected to a single, continuous sill (not shown) for further providing suitable framing for both the door and the sidelight.

As will be appreciated, the similarity in cross-sectional sizes of the filler strips and the internal cavities 156 and 158 advantageously results in an increase in the rigidity of the post member 152 when the filler strip 170 is caused to expand within the cavity 156 or 158 upon insertion of one or more fasteners during fastening, which thereby provides internal reinforcement for the door frame post 150.

It will be understood that door frame post is not limited to use with the door jamb portions described above, and in other embodiments, the door frame post may alternatively be used with a door frame assembly comprising door jamb portions each having a different cross-sectional profile than that of the door jamb portion described above, and/or comprising a header having a different cross-sectional profile than that of the header door jamb portion described above.

Although in the embodiment described above, the door jamb assembly is configured for accommodating a door D and a sidelight panel S, in other embodiments, other configurations are possible. For example, in other embodiments, the panel may be a panel other than a sidelight panel. In still other embodiments, the door jamb assembly may alternatively comprise more than one (1) door frame post, and the door jamb assembly may alternatively be configured for accommodating more than one (1) panel, and/or more than one (1) door. In one such embodiment, the door jamb assembly comprises two (2) doors arranged in a double door configuration, with the door frame post mounting to one of the doors to provide an astragal configuration.

Although in the embodiment described above, the door frame post is provided with the post member already secured to the frame member, in other embodiments, the post member and the frame member may alternatively be cut on site to a suitable size, and then secured to each other on site to provide the door frame post.

Although in the embodiment described above, the post member is fabricated of polyvinyl chloride (PVC) "cap stock", in other embodiments, the post member may alternatively be fabricated of virgin PVC, recycled PVC, or of any other suitable extrudable polymer. In still other embodiments, the post member may alternatively be fabricated of extruded aluminum, extruded aluminum alloy, or pulltruded fiberglass composite.

Although in the embodiment described above, the frame member is formed by machining a longitudinal wooden board, in other embodiments, the frame member may alternatively be formed by machining a longitudinal board of another material, such as for example, plywood, medium-density fibreboard (MDF), particle board, PVC, foamed PVC, or a PVC composite material comprising one or more of wood, flour and rice.

It will be understood that the cross-sectional profile of the post member is not limited to that of the embodiment described above, and in other embodiments, the post member may alternatively have a different cross-sectional profile. For example, the post member may alternatively have a different configuration of longitudinal internal cavities and longitudinal channels. As an example, in other embodiments, the post member may alternatively comprise only a one (1) longitudinal internal cavity configured for accommodating one or more filler strips, or alternatively may comprise more than two (2) longitudinal internal cavities each configured for accommodating one or more filler strips. It will also be understood that the cross-sectional profile of the frame member is not limited to that of the embodiment described above, and in other embodiments, the frame member may alternatively have a different cross-sectional profile.

Although in the embodiment described above, the longitudinal internal cavities and the longitudinal channels of the post member extend the length of the post member, in other embodiments, at least one of the longitudinal internal cavities and/or at least one of the longitudinal channels may alternatively not extend the length of the post member.

Although in the embodiment described above, the filler strips are sized such that each internal cavity accommodates two (2) filler strips inserted therein, in other embodiments, the filler strips may alternatively be sized such that each internal cavity accommodates one (1) filler strip inserted therein, or more than two (2) filler strips inserted therein.

Although in the embodiment described above, each filler strip comprises a plurality of longitudinal cavities extending the length thereof, in other embodiments, the filler strip may alternatively comprise only one (1) longitudinal cavity extending the length thereof. In still other embodiments, the filler strip may alternatively comprise no longitudinal cavity extending the length thereof, and a cavity may alternatively be formed either prior to, or during, fastening of the door frame post to the header.

Although in the embodiment described above, the filler strip is formed of extruded PVC, in other embodiments, the filler strip may be formed of another suitable material.

Although in the embodiment described above, the filler strip is formed by extrusion, in other embodiments, the filler strip may alternatively be formed by another suitable method.

The invention also contemplates a kit of parts which, when assembled, forms the door frame post of one or more of the embodiments described above.

Although embodiments have been described above with reference to the accompanying drawings, those of skill in the art will appreciate that variations and modifications may be made without departing from the scope thereof as defined by the appended claims.

What is claimed is:

1. A door frame post comprising:

an extruded, longitudinal post member comprising at least one longitudinal internal cavity and a longitudinal external channel;

a longitudinal frame member matingly engaging the external channel of the post member; and one or more extruded longitudinal filler strips inserted into the at least one internal cavity, each filler strip comprising at least one longitudinal-extending cavity internal from the outer wall of the filler strip for receiving one or more fasteners.

2. The door frame post of claim 1, wherein each filler strip is formed separately from the post member.

3. The door frame post of claim 1, wherein the one or more fasteners are screws.

4. The door frame post of claim 1, wherein the frame member comprises a shaped longitudinal portion for matingly engaging the external channel of the post member.

5. The door frame post of claim 4, wherein the frame member further comprises at least one longitudinal groove adjacent the shaped longitudinal portion, and wherein the post member further comprises at least one longitudinal clip member disposed adjacent the external channel, each clip member engaging a respective longitudinal groove.

6. The door frame post of claim 1, wherein the post member further comprises at least one additional external channel for accommodating weather stripping.

7. A door frame assembly comprising one or more of the door frame post of claim 1.

8. The door frame assembly of claim 7, further comprising a longitudinal header, the door frame post being fastened to the header intermediate its longitudinal ends.

9. The door frame assembly of claim 7, further comprising a longitudinal sill, the door frame post being fastened to the sill intermediate its longitudinal ends.

10. A kit for assembly of a door frame post, comprising:

an extruded, longitudinal post member comprising at least one longitudinal internal cavity and a longitudinal external channel;

a longitudinal frame member configured for matingly engaging the external channel of the post member; and one or more extruded longitudinal filler strips, each filler strip comprising at least one longitudinal-extending cavity internal from the outer wall of the filler strip for receiving one or more fasteners, each filler strip being one of:

inserted into a respective internal cavity, or configured to be inserted into a respective internal cavity.

11. The kit of claim 10, wherein the frame member is one of (i) separate from, or (ii) secured to, the post member.

12. The kit of claim 10, wherein each filler strip is formed separately from the post member.

13. The kit of claim 10, wherein the frame member comprises a shaped longitudinal portion for matingly engaging the external channel of the post member.

14. The kit of claim 13, wherein the frame member further comprises at least one longitudinal groove adjacent the shaped longitudinal portion, and wherein the post member further comprises at least one longitudinal clip member disposed adjacent the external channel, each longitudinal clip member:

engaging a respective groove, or being configured to engage a respective groove.

15. The kit of claim 10, wherein the post member further comprises at least one additional internal cavity.

16. The kit of claim 10, wherein the post member further comprises at least one additional external channel for accommodating weather stripping.

* * * * *